United States Patent [19]

Chun

[11] Patent Number: 4,915,095

[45] Date of Patent: Apr. 10, 1990

[54] CARDIAC CPR MECHANISM

[76] Inventor: Newton Chun, 2095 John F. Kennedy Rd., Dubuque, Iowa 52001

[21] Appl. No.: 189,070

[22] Filed: May 2, 1988

[51] Int. Cl.[4] ..... A61H 31/00

[52] U.S. Cl. ..... 128/28

[58] Field of Search ..... 128/28, 44, 54, 67; 272/144, 900; 5/508, 494

[56] References Cited

U.S. PATENT DOCUMENTS

| | | | |
|---|---|---|---|
| 2,450,935 | 10/1948 | Carr | 128/67 |
| 2,907,324 | 10/1959 | Catanzaro | 128/71 |
| 3,209,747 | 10/1965 | Guenter | 128/28 |
| 3,241,551 | 3/1966 | Tambascia | 128/51 |
| 3,277,887 | 11/1966 | Thomas | 128/53 |
| 3,401,686 | 9/1968 | Edwards | 128/28 |
| 3,425,409 | 2/1969 | Isaacson et al. | 128/28 |
| 3,509,899 | 5/1970 | Hewson | 128/28 |
| 3,870,038 | 3/1975 | Arblaster | 128/28 |
| 4,060,079 | 11/1977 | Reinhold, Jr. | 128/145.8 |
| 4,326,507 | 4/1982 | Barkalow | 128/54 |
| 4,554,910 | 11/1985 | Lally | 128/28 |
| 4,591,148 | 5/1986 | Slater | 272/900 X |
| 4,664,098 | 5/1987 | Woudenberg et al. | 128/28 X |
| 4,702,231 | 10/1987 | Arpin | 128/28 |

*Primary Examiner*—Richard J. Apley
*Assistant Examiner*—H. Flaxman
*Attorney, Agent, or Firm*—Hill, Van Santen, Steadman & Simpson

[57] ABSTRACT

A cardiopulmonary resuscitation device which provides a combination of heart and lung compression by simultaneous compression of the heart and lung substance. The device may be rapidly installed on the patient with clip on straps which may already be in place where the patient is lying such as in an intensive care unit by merely pulling up on the straps and clipping onto the compressor which can be operated with a handle to simultaneously compress the heart and the lungs. The procedure may be continued for long periods of time without tiring the doctor or other person applying the resuscitation.

6 Claims, 3 Drawing Sheets

FIG. 6
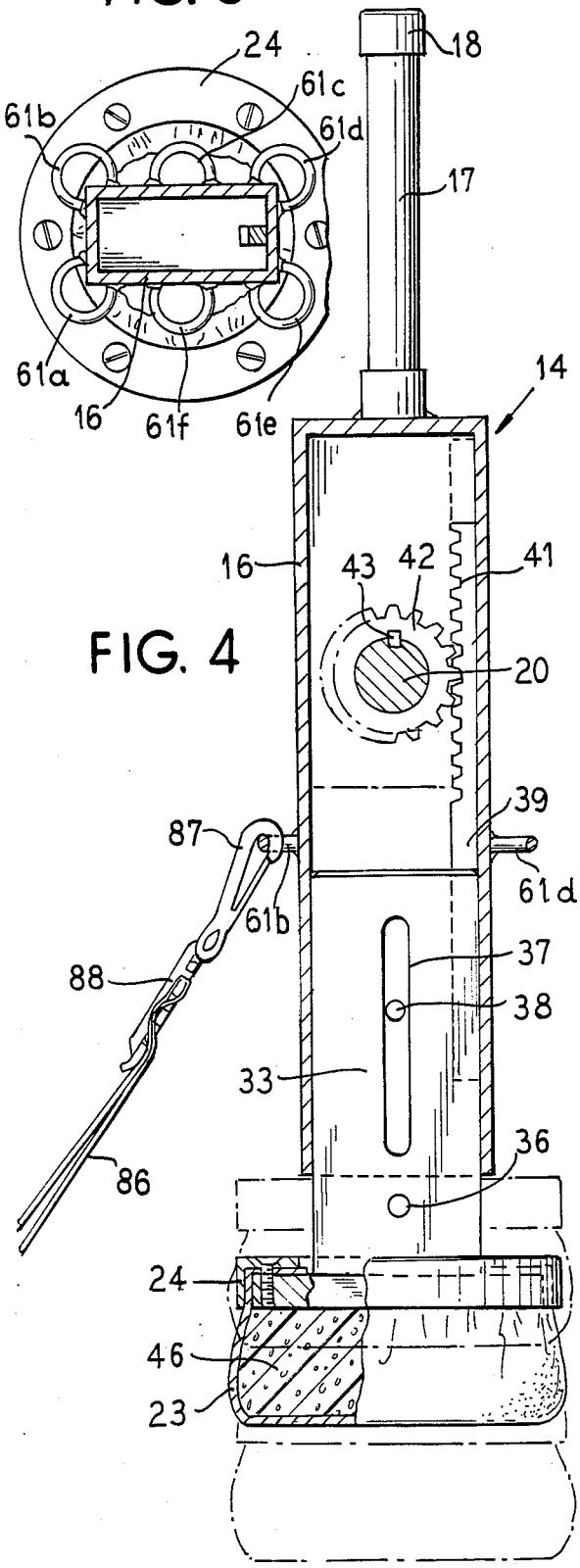
FIG. 4
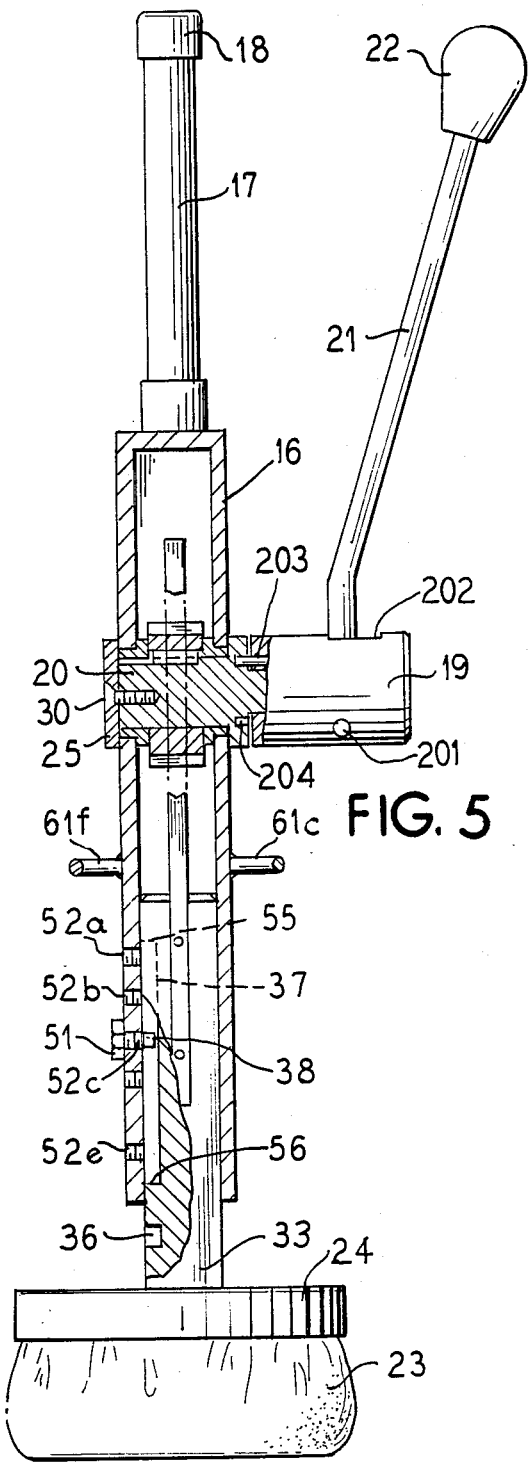
FIG. 5

FIG. 7
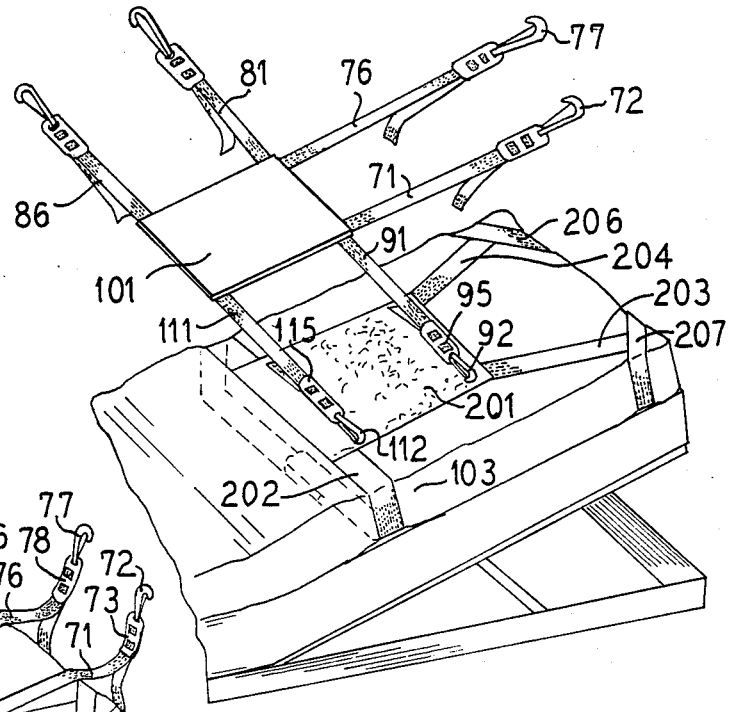
FIG. 8
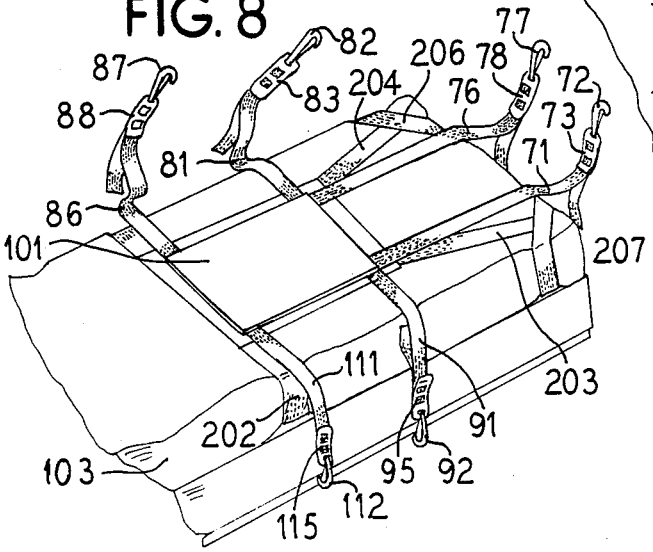
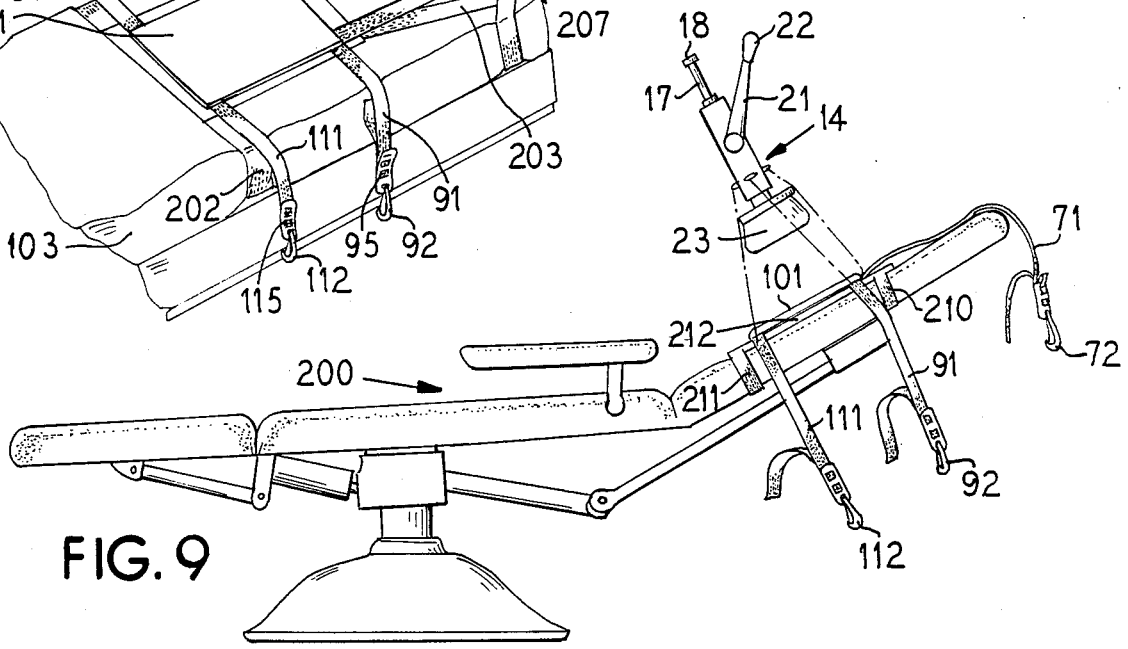
FIG. 9
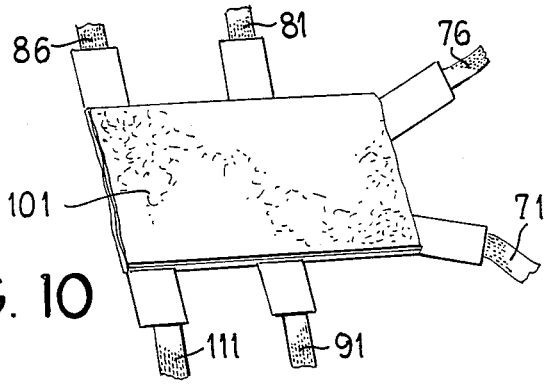
FIG. 10

CARDIAC CPR MECHANISM

BACKGROUND OF THE INVENTION

1. Field of the Invention

The present invention relates to cardiopulmonary resuscitation devices and in particular to a novel device which can be quickly and easily mounted to a patient to allow rapid commencement of the cardiopulmonary resuscitation procedure.

2. Description of the Prior Art

The manual application of cardiopulmonary resuscitation is well known wherein the doctor or nurse or other person who happens to be present when the emergency procedure is required must alternately compress the chest by leaning over the patient after first getting the patient into a proper position for such procedure. Such procedures are very tiring to the doctor or nurse during a ten minute period requiring interchange of resuscitator and particularly when such procedures must be continued for long periods of time. A heart lung resuscitator litter unit disclosed in U.S. Pat. No. 4,060,079 uses a backboard which has an automatic heart lung resuscitator which is operated by air pressure. However, the stiff backboard tends to encourage excessive chest compression causing complications including laceration of liver, fracture cf ribs, contusion of heart, broken ribs on the patient and has other disadvantages. Also, see U.S. Pat. No. 4,326,507, 4,554,910, 2,450,935, 3,401,686, 3,277,887 and 3,425,409.

SUMMARY OF THE INVENTION

The present invention provides a combination of chest compression effecting compression of the heart and lungs and uses encircling straps around the thorax which can be termed a thorace cuirass effectively compresses the heart and lungs in cardiopulmonary resuscitation. The resuscitation device may be rapidly installed on the patient using clips which may already be in place on the support on which the patient is lying such as in an intensive care unit and the compression can be started very quickly by pulling up the straps and clipping them onto the compressor after which immediately compression can commence.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 4 is a side plan view partially cut-away of the compressor of the invention;

FIG. 5 is a plan view of the compressor of the invention partially cut-away;

FIG. 6 is a top plan view of the compressor of the invention;

FIG. 7 is a partially cut-away perspective view showing the invention being installed on a bed;

FIG. 8 is a perspective view showing the strap arrangement mounted on the bed;

FIG. 9 illustrates the invention installed on a dental chair; and

FIG. 10 is a perspective view illustrating the strap arrangement of the device.

DESCRIPTION OF THE PREFERRED EMBODIMENTS

Figure 1:
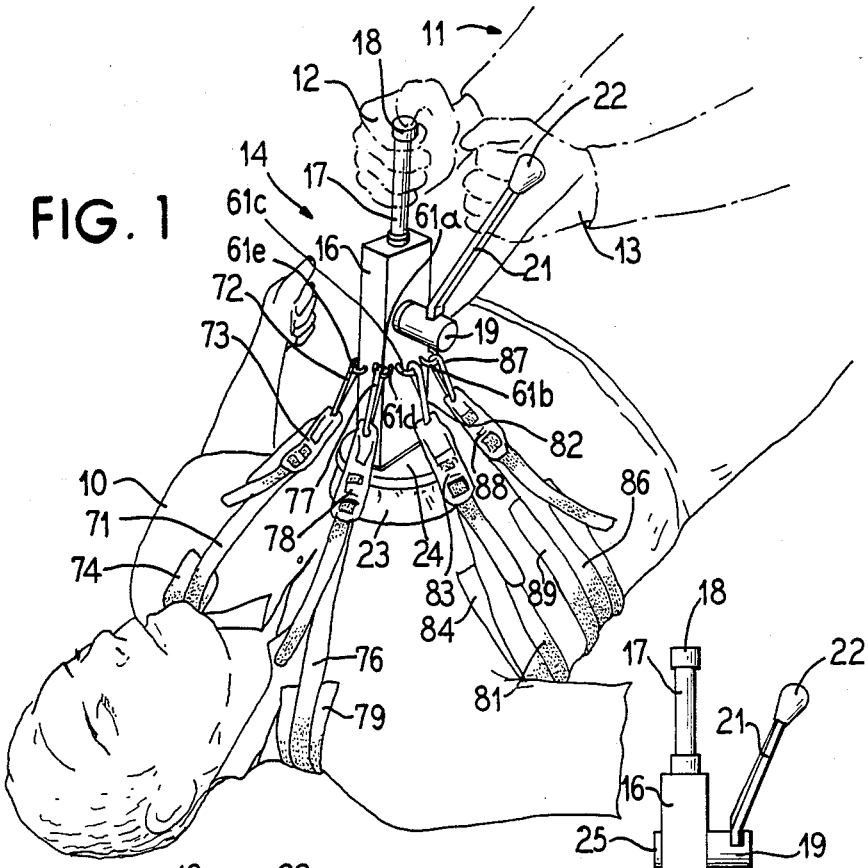
FIG. 1 is a perspective view illustrating a patient being given cardiopulmonary resuscitation.

FIG. 1 illustrates a patient 10 to which the cardiopulmonary resuscitation device of the invention has been attached and is being operated by a person 11. The person 11 applies one hand 12 to a support shaft 17 that has a handle 18 and the other hand 13 is used to operate a lever 21 which has a handle 22 of the cardiopulmonary resuscitation device 14. The cardiopulmonary resuscitation device 14 has a generally rectangular body-shaped portion 16 and as shown in FIGS. 1–6, a shaft 20 is rotatably supported by the body member 16 and has one end attached to the hub 19 which carries a handle 21 and the other end of shaft 20 is connected to a hub 25 which is held by set screw 30 to the shaft 20 as illustrated in FIG. 5. As shown in FIG. 4, a gear 42 is non-rotatably attached to shaft 20 by a key 43 which is received in mating slots in the gear 42 and the shaft 20. A rack 41 is mounted in the member 16 and meshes with the teeth of the gear 42 so as to drive a piston member 33 that carries the resuscitation pad 23. The piston member 33 is connected to an end support 24 of the pad 23 by a pivot pin 36. A slot 37 is formed in the piston member 33 and a set screw 38 which has a head 51 can be mounted in different threaded openings **52*a* through 52*e* formed in the member 16 as illustrated in FIG. 5 such that the end 38 of the set screw fits into the slot 37 so as to limit the motion of the piston 33 by engaging the ends 55 and 56 of the piston 33. When not in use the screw 38 can be received in opening 36** to lock the device.

The compressor portion 23 may be filled with foam rubber 46 or other suitable material for example.

Figure 2:
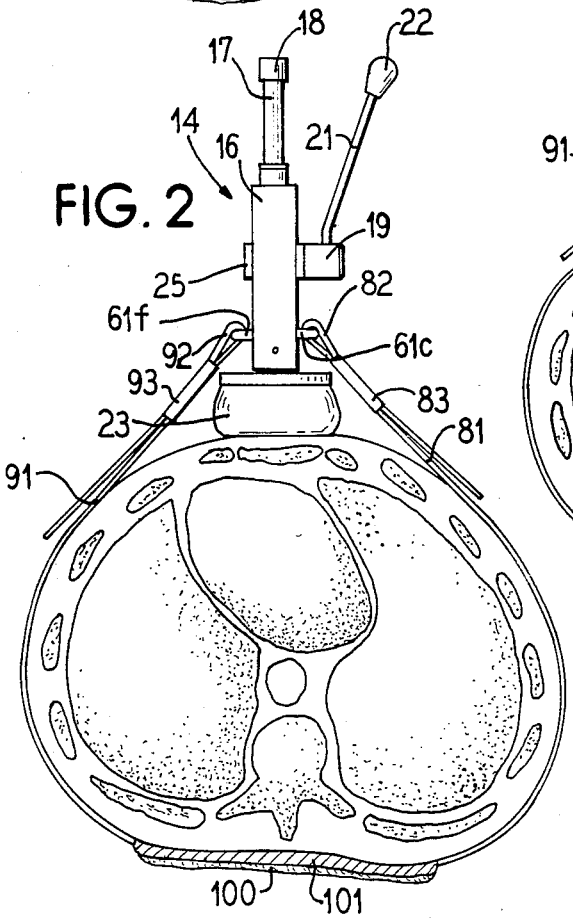
FIG. 2 is a sectional view through the thorax of the patient in an uncompressed condition.
Figure 3:
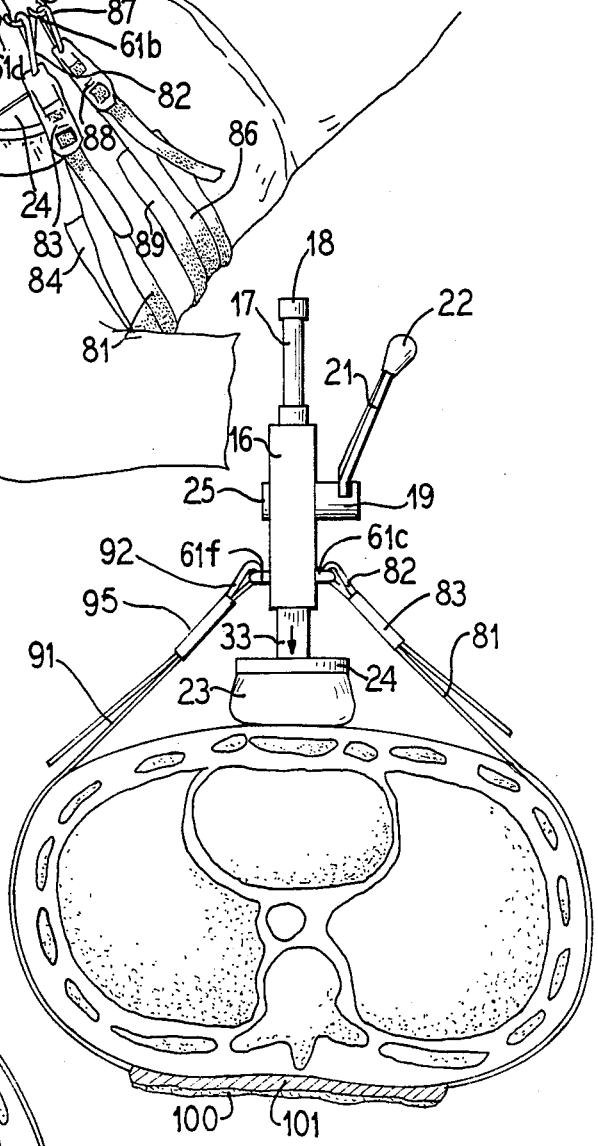
FIG. 3 is a sectional view through the thorax of the patient during the compressed condition.

As is shown in FIGS. 2 and 3, a flexible back pad 101 which has its back side covered with velcro 100 is placed under the patient and straps 71, 76, 81, 86 and 91 and 111 are attached to the pad 101 as shown in FIG. 10, for example. Each of the straps respectively carries a snap buckle. For example, strap 76 which goes over the shoulder of the patient 10 carries a buckle 77 and an adjustment means 78 and can be snapped into a ring **61*a* attached to the body 16 of the compressor 14. The strap 71 carries a buckle 72 and an adjustment means 73 and the snap 72 can be received in a ring 61*b* on the body member 16. The strap 81 carries a snap 82 and an adjustment means 83 and is receivable in a ring 61*c* illustrated in FIG. 6. The strap 86 carries a snap 87 and an adjustment means 88 and is receivable in a ring 61*c* mounted on the member 16. The strap 91 carries a snap 92 and an adjustment means 95 and is receivable in a snap ring 61*c* on member 16. The strap 111 carries a snap 112 and an adjustment means 115 and the snap 112 is receivable in a ring 61*d* on member 16**.

The back pad or thoracic cuirass 101 as illustrated in FIGS. 7, 8 and 10 may be in place on a bed 103 ready for use. As shown in FIGS. 2 and 3, the pad 101 may have velcro 100 or hooks and loops on its back which is attachable to a pad 201 which has velcro on its top surface as shown in FIG. 7. The pad 201 is held by straps 202 which go around the mattress and join as well as straps 203 and 204 which pass under corner straps 206 and 207 mounted on the bed. In other words, the pad 201 is in place on the mattress 103. The pad 101 is attached to the pad 201 by connecting the velcro 100 on the back of pad 101 to the velcro on the top of pad 201 and the straps 71, 76, 81, 86, 91 and 111 are left loose hanging down the top and opposite sides of the bed as is generally shown in FIG. 8. The patient is then placed on the bed and in the event that he requires cardiopulmonary resuscitation, the resuscitation device 14 can be quickly attached to the straps 71, 76, 81, 86, 91 and 111 as shown in FIG. 1 by connecting the snaps 72, 77, 82, 87, 92, and 112 to the rings 61 on the member 16. The straps can be quickly adjusted by pulling on their ends and then resuscitation can be started by the operator by taking the position shown in FIG. 1. FIG. 2 illustrates the uncompressed position of the heart and lungs and FIG. 3 illustrates the position where the handle 21 has been rotated to compress the heart and lungs. This is periodically done at the rate which is selected by the operator and which is well known for applying heart and lung resuscitation. The straps and the back pad 101 are flexible and thus as compression forces is applied to the pad 23 by the piston 33, the thorax is compressed by applying circumferential compression forces completely around the body.

FIG. 9 illustrates a modification wherein the pad 100 is connected to the top portion of a dental chair 200 using straps 210 and 211 which hold a pad 212 that has velcro on its top surface. The pad 101 is connected to the pad 212 by using the velcro 100 on the back of the pad 101. In the event that a patient in the dental chair 200 requires cardiopulmonary resuscitation, the straps are attached to the member 16 as illustrated in FIG. 1 and cardioresuscitation is commenced.

In the invention, the bottom straps are not attached to a board which more evenly distributes the thoratic pressure which avoids local force on the interior ribs which can break and cause complications such as occur with the conventional CPR units as shown in U.S. Pat. No. 3,425,409. The invention also has an adjustable throw and the handle can also be rotatably adjusted by pivoting the handle transversely in a slot 202 about a pivot pin 201 in hub 19. This moves locking pin 203 from one of a series of openings 204 in shaft so that the handle position may be varied. The adjustable straps can be adjusted for persons of different sizes.

The device can also be used at the site of accidents such as automobile accidents. The invention actively compresses the heart and lungs so as to propel blood out of the heart. This is more effective due to the flexible backing material. It has been shown by recent scientific experiments that compression alone of the lungs can propel blood out of the heart rate the circulation. (See Modification of Cardiopulmonary Resuscitation Based On The Cough by Criley et al, Circulation 74 (Suppl. IV) IV-42, 1986.

The device is simple so that any person can operate it and is adjustable to fit persons of different sizes.

Although the invention has been described with respect to preferred embodiments, it is not to be so limited as changes and modifications can be made which are within the full intended scope of the invention as defined by the appended claims.

I claim as my invention:

1. A cardiopulmonary resuscitator device for a patient formed of two separable components which will facilitate the immediate institution of resuscitation by an additive effect of both heart and lung compression comprising:

(1) a multibelted strong soft cloth-backed cuirass harness consisting of encircling strap means for ensuring lateral and vertical stability of an attachable chest compressor, a plurality of quick release means on each of said strap means;

(2) a portable attachable chest compressor with a padded compressor head which is operated manually by a multipositional rack and pinion drive, wherein said rack and pinion drive is actuated by an adjustable lever handle, and wherein said chest compressor can be quickly attached to said strap means by said quick release means, a plurality of tension-tightening sliding buckles attached to said strap means which can be adjusted to adequate tension to stabilize said padded compressor head over the lower, slightly leftward portion of the sternum of said patient so that actuation of said manual lever handle will cause simultaneously compression of the heart of said patient against the spine and portion of the adjacent posterior chest wall and, simultaneously said harness will compress the lungs and arrested heart of said patient with each chest compression stroke so that by compressing the lungs blood will move through the uncompressed heart, and an upright stabilizing handle attached to said chest compressor so as to stabilize said chest compressor as said lever handle is actuated.

2. A manual cardiopulmonary resuscitation apparatus according to claim 1 including an attaching pad which can be attached to a planar patient support, and means for attaching said cuirass to said attaching pad.

3. A manual cardiopulmonary resuscitation apparatus according to claim 2 wherein said means for attaching comprises hook and eye layers respectively connected to mating surfaces of said cuirass and to said attaching pad.

4. A manual cardiopulmonary resuscitation apparatus according to claim 1 including means for adjusting the length of travel of said padded compression head relative to said chest compressor.

5. A manual cardiopulmonary resuscitation apparatus according to claim 1 wherein said padded compressor head applies additive force for both heart and lung compression.

6. A cardiopulmonary resuscitator device according to claim 1 including means for adjusting the position of said lever handle relative to said pinion so that the position of said lever handle can be varied.

* * * * *